US011136733B2

(12) United States Patent
Kollegger et al.

(10) Patent No.: US 11,136,733 B2
(45) Date of Patent: Oct. 5, 2021

(54) METHOD FOR PRODUCING AN INTEGRAL BRIDGE, AND INTEGRAL BRIDGE

(71) Applicant: TECHNISCHE UNIVERSITÄT WIEN, Vienna (AT)

(72) Inventors: Johann Kollegger, Klosterneuburg (AT); Georg Gassner, Rossatz (AT)

(73) Assignee: TECHNISCHE UNIVERSITAT WIEN, Vienna (AT)

( * ) Notice: Subject to any disclaimer, the term of this patent is extended or adjusted under 35 U.S.C. 154(b) by 0 days.

(21) Appl. No.: 16/641,575

(22) PCT Filed: Jul. 26, 2018

(86) PCT No.: PCT/AT2018/060163
§ 371 (c)(1),
(2) Date: Feb. 24, 2020

(87) PCT Pub. No.: WO2019/036735
PCT Pub. Date: Feb. 28, 2019

(65) Prior Publication Data

US 2020/0248414 A1 Aug. 6, 2020

(30) Foreign Application Priority Data

Aug. 24, 2017 (AT) ..... A 50705/2017

(51) Int. Cl.

| | |
|---|---|
| ***E01D 19/00*** | (2006.01) |
| ***E01D 19/14*** | (2006.01) |
| ***E01D 4/00*** | (2006.01) |
| ***E01D 19/04*** | (2006.01) |
| ***E01D 21/00*** | (2006.01) |

(52) U.S. Cl.
CPC ..... *E01D 19/14* (2013.01); *E01D 4/00* (2013.01); *E01D 19/042* (2013.01); *E01D 21/00* (2013.01)

(58) Field of Classification Search
CPC ..... E01D 4/00; E01D 19/042; E01D 19/14; E01D 21/00
USPC ..... 14/22–26
See application file for complete search history.

(56) References Cited

U.S. PATENT DOCUMENTS 95,784 A * 10/1869 Eads et al. ..... E01D 4/00 14/24
141,310 A * 7/1873 Bender et al. ..... E01D 11/04 14/24
501,969 A * 7/1893 Stephens ..... E01D 1/005 14/25

(Continued)

*Primary Examiner* — Raymond W Addie
(74) *Attorney, Agent, or Firm* — Workman Nydegger

(57) ABSTRACT

A first arch and second arch are produced in respective first and second structural portions. Each arch has a tie rod interconnecting the foot points of the arch, where a foot point of the arch is displaceably mounted. Each tie rod is tensioned so that horizontal forces caused by the weight of the arches at the foot points of the corresponding arch, are taken up by the tie rods. A first end point of the tie rod of the first arch is connected in a force-fitting manner to the first abutment, and a second end point of the tie rod of a last arch is connected in a force-fitting manner to the second abutment. The remaining adjoining end points of the tie rods are connected to one another in a force-fitting manner, and corresponding foot points of the arches are connected in a force-fitting manner to the abutments and pillar.

20 Claims, 5 Drawing Sheets

(56) References Cited

U.S. PATENT DOCUMENTS

| | | | | | |
|---|---|---|---|---|---|
| 565,020 | A * | 8/1896 | Newburg | E01D 1/005 | 14/73 |
| 1,163,641 | A * | 12/1915 | Cummings | E01D 22/00 | 14/2 |
| 1,761,306 | A * | 6/1930 | McKeown | E04G 13/04 | 249/18 |
| 2,308,334 | A * | 1/1943 | Luke | E01D 4/00 | 52/87 |
| 2,854,742 | A * | 10/1958 | Guild | E01D 21/08 | 29/428 |
| 3,377,637 | A * | 4/1968 | Ramirez | E04C 3/40 | 14/24 |
| 4,620,400 | A * | 11/1986 | Richard | E01D 2/00 | 52/223.9 |
| 4,691,399 | A * | 9/1987 | Kim | E01D 22/00 | 14/10 |
| 4,694,622 | A * | 9/1987 | Richard | E04C 3/10 | 14/22 |
| 4,993,094 | A * | 2/1991 | Muller | E01D 21/10 | 14/77.1 |
| 7,146,672 | B1 * | 12/2006 | Meheen | E01D 4/00 | 14/2 |
| 2011/0194897 | A1 * | 8/2011 | Clark | E04B 5/32 | 404/70 |

* cited by examiner

METHOD FOR PRODUCING AN INTEGRAL BRIDGE, AND INTEGRAL BRIDGE

The present application is a U.S. National Stage Entry of International Application No. PCT/AT2018/060163, filed on Jul. 26, 2018, designating the United States and claiming the priority of Austrian Patent Application No. A 50705/2017, filed with the Austrian Patent Office on Aug. 24, 2017. All of the aforementioned applications are incorporated herein in their respective entireties by this reference.

The invention relates to a method for producing an integral bridge as well as to bridges produces according to this method.

Bridges without bearings or expansion joints are called integral bridges. The world-wide tendency in bridge construction is definitely towards integral construction methods, as bearings and expansion joints are parts that are subject to wear, which have to be replaced at regular intervals.

With currently built integral bridges, the changes in length of the bridge support formed as beams as a consequence of temperature drops in winter or temperature rise in summer, respectively, result in shifts at the abutments, which do not constitute a great problem if the total length of the bridge is at the most 70 m. In the case of longer bridges, however, there are required bearings and expansion joints at the abutments in order to enable a compensation of the temperature-related deformations.

With arched bridges, the problems occurring with beam bridges in regard to the temperature-related length shifts of the bridge support may be prevented. Roman bridges such as, for instance, the Alcantara Bridge crossing the river Tajo in Spain, have semi-circular arches and wide pillars. The ratio of the clear arch span width to the clear rise of the arch has in Roman bridges with semi-circular arches the value of 2.0. Loads from intrinsic weight and traffic are taken up by the arches and transmitted into the foundation. On the arches there is provided a filling material, covered by the roadway. The filling material and the roadway are not able to take up tensile or compressive forces acting in the longitudinal direction of the bridge. A warming of the bridge in summer, hence, will lead to vertical shifts of the arches, the filling material and the roadway upwards. A cooling of the bridge in winter will cause downward oriented vertical deformations.

Between the undisplaceable abutments, there will occur more or less no deformations in the longitudinal direction of the bridge in the case of a temperature rise or a temperature drop. For this reason, the pillars will not be subjected to bending stress by the temperature differences in the bridge. Roman bridges are integral bridges, which may be constructed in any lengths.

The width of the pillars in Roman bridges is very large. The large width of the pillars requires a high material consumption, having, however, the advantage that the arches could be produced one after the other. The large weight of the pillars had the effect that the horizontal forces from the intrinsic weight of the arch last produced could be transmitted into the foundations.

The amount of material used for arch bridges is reduced if the ratio of the arch span width to the rise of the arch increases. This material saving, however, causes higher horizontal forces at the foot points of the arches. The horizontal forces as a consequence of the intrinsic weight of an arch will become larger if the ratio of the arch span width to the rise of the arch increases.

A further reduction of the amount of material used in arch bridges will be possible if the width of the pillars is reduced.

Such a bridge having a large ratio of the arch span width to the rise of the arch and having reduced pillar dimension is described by Aad van der Horst et al. in the article "Stadsbrug Nijmegen" in the IABSE Rotterdam Symposium Report, Volume 99, number 21, 2013, pages 724-729.

The integral outland bridge of the Stadsbrug Nijmegen on the northern side of the river Waal has 16 arches and a length of 680 m. The first and the last arch are each rigidly connected with respectively one foot point to the nearly undisplaceable abutments. The other arch foot points are mounted on pillars. At the bridge, there are no expansion joints. The connections between the arches, the abutments and the pillars are formed in a manner resistant to bending. On the arches, there is provided cellular concrete forming the support of the road deck. The road deck has transverse joints at regular intervals. The reinforced concrete arches have a span width of 42.50 m, a rise of the arch of 5.30 m and, hence, a ratio of the arch span width to the rise of the arch of 8.0 m.

The horizontal forces at the arch foot points as a consequence of the intrinsic weight will be neutralized above each pillar in the final condition. In the final condition, the pillars will be stressed by the intrinsic weight of the bridge only by normal forces. The horizontal forces of the arch foot points, which are connected to the abutments, have to be taken up by the abutments.

Also a warming of the bridge in summer or a cooling of the bridge in winter will not cause any bending moments in the pillars, as the bridge is arranged between two undisplaceable abutments and as the temperature differences are taken up in the arches by deformations and bending stresses. In the case of a warming with a temperature difference to the manufacturing temperature of 30°, the arch will deform upwards by approximately 29 mm.

Uniformly distributed traffic loads, similarly to the intrinsic weight stress, will lead to vertical normal force stresses in the pillars.

Panel-wise arranged traffic loads will cause bending stresses in the arches and in the pillars. The pillars have to be formed having such a width in order to provide for the take-up of panel-wise arranged traffic loads.

In the final condition, the horizontal forces at the foot points of the arches as a consequence of the intrinsic weight of the arches are neutralized above the pillars. If the bridge is produced in individual structural portions, then this will not be the case during production. For this reason, there had to be taken additional measures during the portion-wise production of the bridge Nijmegen in order to take up the horizontal forces from the intrinsic weight of the arches. In a structural portion there were constructed three arches at the same time. The arches were stabilized by temporary tie rods, which were arranged horizontally above the arches. There were further used temporary, obliquely arranged bracings between the foot points of the arches and the foundations.

Another problem with the construction manner used for the bridge Nijmegen is that the failure of an arch may cause the entire bridge to collapse. In the case of a failure of an arch, the horizontal forces of the subsequent arches have to be removed via bending by the two pillars, which had taken up the intrinsic weight of the failing arch. This will either have the consequence that massive pillars have to be constructed or that a total collapse of the bridge in the case of a failure of an arch is accepted.

The problem of the bending stresses in the pillars as a consequence of the panel-wise traffic load may be reduced by horizontal tie rods between the pillar foot points. The horizontal force of the traffic-loaded arch are, in great part, taken up by the tie rod, which interconnects the two foot points of the arch.

A bridge having horizontal tie rods is, for example, described in the book "Handbuch für Eisenbetonbau", published by Friedrich Ignaz Edler von Emperger, $6^{th}$ volume: Brückenbau, second edition, publisher Wilhelm Ernst & Sohn Berlin, 1911, on the pages 642 to 644. The railroad bridge "Elevated railway to the new Valby gasworks near Copenhagen" is a reinforced concrete construction having a total length of 565.6 m. In order to enable the take-up of temperature-related changes in length of the bridge without any large restraints, there were arranged transverse joint at intervals of approximately 55 m. In-between two transverse joints there was constructed an anchor point in the form of a double pillar strutted by a timber frame construction. The arches arranged in the longitudinal direction of the bridge underneath the road deck have lengths of approximately 9.7 m. The foot points of the arches are interconnected by tie rods.

The double pillars acting as anchor points are connected to the foundations in a manner resistant to bending. The remaining pillars were formed as pendular rods having hinges at the foot points and at the upper connecting points with the arches.

In the case of a warming of the bridge, the road decks, the arches and the tie rods arranged between the foot points of the arch will expand, leading to an oblique inclination of the pendular pillars, which will be larger the farther a pendular pillar is distanced to the anchor point.

Bridges having bearings, transverse joints and road passages arranged in the transverse joints cause high maintenance costs, as the bearings and the road passages are parts that are subject to wear, which have to be replaced at regular intervals. In DE 539 580, lines 32 to 35 of the specification, there is annotated that a significant disadvantage of a construction method comparable with the elevated railway to the new Valby gasworks is that the tie rods will change their length in the case of temperature variations.

In DE 539 580, hence, there is proposed to install tie rods between two undisplaceable abutments and to pre-tension these before the construction of the bridge proper. The expansion of the tie rods that is caused by pre-tensioning is to be chosen as high as possible such that the "tie rods will not relax even in the case of a maximum warming" (translation; lines 46 to 48). The mode of action of such an arched bridge having pre-tensioned tie rods is described in lines 53 to 62: "If the individual intermediate pillars are connected to the tie rods installed, anchored and pre-tensioned in this manner, only the individual portions between the pillars will experience elastic length changes if the horizontal thrust of the arches in the individual openings changes as a consequence of changing stress, but no changes in length as a consequence of temperature variations" (translation).

A substantial disadvantage of the construction method described in DE 539 580 for the production of an arched bridge are the large tensile forces, which are transmitted into the abutments in the case of a pre-tensioning of the tie rods or a temperature drop in the tie rods. These tensile forces act at a large height above the foundations and, hence, cause high bending moments, which are to be taken up by the abutment and the foundations. The abutment and the foundations, for this reason, have to be built in a massive way. Another disadvantage is the cumbersome production. In the case of longer bridges, additional temporary supports will be necessary in order to maintain the previously produced tie rods in a horizontal position, as the sagging of a pre-tensioned tie rod as a consequence of the intrinsic weight is dependent on the length, as is commonly known. Another disadvantage is that temporary tie rods are required during the production of the arched bridge if this is produced portion-wise. A production in a structural portion will only be economic for bridges having a small length.

It is the task of this invention to provide a method for producing an integral bridge and an integral bridge, wherein the problems and disadvantages mentioned above are reduced and/or will not occur.

The present invention solves this task by providing a method for producing an integral bridge according to claim 1 as well as by bridges produced according to this method according to claim 18. Advantageous developments of the invention are defined in the sub-claims.

An inventive method for producing an integral bridge made from reinforced concrete and having at least two arches and at least one pillar, wherein the bridge is produced portion-wise, wherein there are preliminarily erected a first abutment, the at least one pillar and optionally a second abutment, is characterized in that

- in a first structural portion there is produced a first arch with at least one tie rod, which interconnects the foot points of the arch, wherein a foot point of the arch is displaceably mounted;
- the at least one tie rod is so highly tensioned that the horizontal forces, which are caused by the intrinsic weight of the arch at the foot points of the corresponding arch, are taken up by the tie rod;
- in at least one further structural portion there is produced at least one further arch with at least one tie rod, which interconnects the foot points of the arch, wherein a foot point of the arch is displaceably mounted;
- optionally before or during the at least one further structural portion there is produced the second abutment,
- the at least one tie rod is so highly tensioned that the horizontal forces, which are caused by the intrinsic weight of the arch at the foot points of the corresponding arch, are taken up by the tie rod;
- a first end point of the tie rod of a first arch is connected in a force-fitting manner to the first abutment, and a second end point of the tie rod of a last arch is connected in a force-fitting manner to the second abutment;
- the remaining, in each case adjoining end points of the tie rods are connected to one another in a force-fitting manner; and
- the corresponding foot points of the arches are connected in a force-fitting manner to the abutments and to the at least one pillar.

With the method according to the invention, there may be produced integral bridges having large lengths in a portion-wise way, without having to take additional, technically cumbersome, time-consuming and/or expensive measures in order to take up the horizontal forces from the intrinsic weight of the arches, as is described above. Furthermore, it is impossible with the inventive bridges that a failure of one arch will lead to the entire bridge collapsing. With the method according to the invention, the tie rods need not be supported in a technically cumbersome way during production, but may rather be introduced at the best point of time and adjusted in regard to the horizontal forces arising.

Advantageously, in the method according to the invention one connection, preferably all connections, of one/of the foot point/s is/are realized using at least one pillar during a structural portion of the integral bridge.

Advantageously, in the method according to the invention at least one force-fitting connection, preferably all force-fitting connections, of end points of the tie rods is/are realized during the portion-wise production of the integral bridge.

Advantageously, in the method according to the invention at least one tie rod, preferably all tie rods, are tensioned to a tensile strength of 80 $N/mm^2$ to 500 $N/mm^2$, preferably from 100 $N/mm^2$ to 200 $N/mm^2$.

In an advantageous embodiment of the method according to the invention, one end point of a tie rod is formed as a solid anchorage and/or one end point of a tie rod is formed as a jacking anchorage and/or one end point of a tie rod is formed as a coupling.

Advantageously, there is formed in the method according to the invention one tie rod as a tendon having a subsequent connection in a sheathing, preferably made from plastic material, and is then compressed with cement mortar after tensioning the tie rod.

In an advantageous embodiment of the method according to the invention at least one tie rod is formed as an external tendon, wherein the tie rod is equipped with a permanent corrosion protection, preferably during the portion-wise production of the integral bridge, or is produced from a material not at risk of corrosion, preferably from a glass fibre composite material or a carbon fibre composite material.

In the method according to the invention, there are usefully produced supports on at least one arch, and the road deck is produced on the supports.

The tie rod is advantageously tensioned so highly such that the horizontal forces, which are caused by the intrinsic weight of the arch, the supports and the road deck at the foot points of the arch, are taken up by the tie rod.

Transverse joints in the road deck, in particular in lateral projections of the road deck, are produced at an interval of 1 m to 10 m, preferably from 2 m to 4 m.

Especially usefully, rods made from fibre composite material and/or from stainless steel are installed in the road deck, where the rods cross the transverse joints.

In an advantageous embodiment of the method according to the invention, the arch, the supports and the part of the road deck, which is arranged above the arch, are simultaneously produced in a construction part, and in the construction part there are produced slits having an essentially plane top surface, which lie in planes, which are arranged perpendicularly to the axis of a tie rod, wherein the slits have a depth extending from the top surface of the construction part to the top surface of the arch.

In an advantageous embodiment of the method according to the invention, the arch, the supports and the part of the road deck, which is arranged above the arch, are simultaneously produced in a construction prat, and in the construction part having an essentially plane top surface, and an essentially plane bottom surface, slits are produced which lie in planes, which are arranged perpendicularly to the axis of a tie rod, wherein the slits have a depth extending either from the bottom surface of the construction part to the bottom surface of the arch or from the top surface of the construction part to the top surface of the arch.

In the construction part a reinforcement is usefully installed made from fibre composite material and/or made from stainless steel.

In an advantageous embodiment of the method according to the invention, two or more arches are connected to a common tie rod, which is rigidly connected at the first end point thereof to a foot point of the first arch and which is displaceably connected at the second end point thereof to a foot point of the last arch.

In an advantageous embodiment of the method according to the at least two arches in at least one structural portion are produced.

In an advantageous embodiment of the method according to the invention, on the supports of an arch in turn arches are produced having a smaller arch span width and tie rods and the road deck.

An integral bridge according to the invention made from reinforced concrete and having at least two arches and at least one pillar is characterized in that each arch has at least one tie rod, which interconnects the foot points of the arch, wherein the ratio of the clear arch span width to the clear rise of the arch has a value of larger than 2, preferably larger than 4, even more preferably larger than 6, most preferably larger than 8.

In an integral bridge according to the invention the ratio of the clear arch span width to the width of the at least one pillar in the longitudinal direction of the bridge has advantageously a value of larger than 5, preferably larger than 10, even more preferably lager than 15 and most preferably larger than 20.

In the following the invention will be described by way of non-limiting embodiment examples that are depicted in the drawings. In the schematic illustrations:

Figure 1:
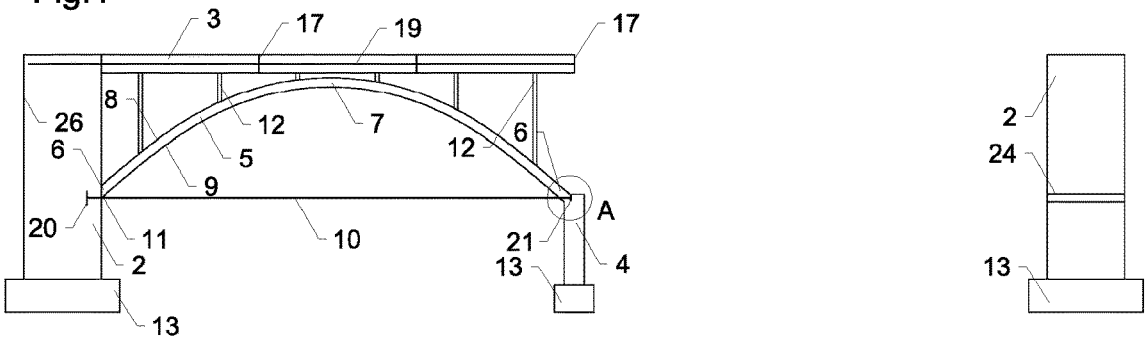
FIG. 1 shows a sectional view through an integral bridge during a first structural portion of a method according to the invention according to a first embodiment.

In the following exemplary embodiments there is fundamentally produced the "first arch" in a first structural portion, the "second arch" in a second structural portion and so on, and the "last arch" in a last structural portion. The designation "structural portion" relates in the following description always to the production of at least one arch. References such as "left" or "right" relate to the depiction in the figures. In general, the enumerations (for example, "first" end point, "second" end point and so on) are to be considered in reference to the figures from the left to the right hand-side. The designations "panel", "panels", etc. relate to one/the bridge portion/s between two pillars or between one pillar and one abutment.

In the following, there is first made reference to the FIGS. 1 to 8, in which the production of an exemplary integral bridge 1 using a method according to the invention according to a first embodiment is described.

For the production of a first arch 5 in a first structural portion, there is in a first step preliminarily required the production of a first abutment 2 and of a pillar 4. A second abutment 2 may be produced simultaneously with the production of a first arch 5 or also preliminarily in the first step. An integral bridge 1 produced using a method according to the present invention may also have more than two abutments 2, for example, if the bridge has a junction of the roadway.

In the first structural portion the first arch 5 is produced on a formwork and a supporting frame, which are not depicted in FIG. 1 for reasons of clarity.

In the next step there may be produced on a top surface 8 of the first arch 5 supports 12 and subsequently a road deck 3 having transverse joints 17. In the road deck 3 there are installed rods 19, which cross the transverse joints 17 at an approximately right angle.

The depicted supports 12 as well as the road deck 3 are to be considered as examples. Those skilled in the art will know alternative embodiments of the supports 12, for example, there may be used various supporting frames, pillars or a continuous filling with material, for example, concrete. Those skilled in the art similarly know alternative embodiments of the road deck 3, for example, there may be used several (roadway) levels for vehicles, persons, rail track routing, rail tracks or rails.

The foot point 6 of the first arch 5, which is arranged next to the first abutment 2, is connected to the first abutment 2 in a way resistant to bending during the production of the first arch 5. The production of a connection that is resistant to bending is, for example, possible without any problems in the reinforced concrete method using a connecting reinforcement projecting out of the abutment 2.

In a next step there is installed a tie rod 10 in-between the foot points 6 of the first arch 5. The tie rod 10 is connected at the first end point (11) thereof to the first abutment 2 using a solid anchorage 20 in an undisplaceable way, this is in a force-fitting manner. Above the pillar 4, the tie rod 10 is for this reason equipped preferably with a jacking anchorage 21. The tie rod 10 may, for example, be formed as an external tendon made from high-strength pre-stressed steel in a plastic sheath pipe. External tendons are well-proven construction elements, which may be formed with solid anchorages 20, jacking anchorages 21 and couplings 22.

Figure 2:
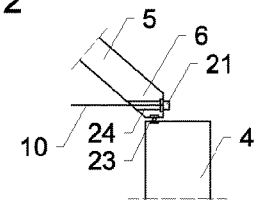
FIG. 2 shows the detail A of FIG. 1.

FIG. 2 shows that the foot point 6 of the first arch 5, which is arranged above the pillar 4, may be mounted in the construction condition on a friction bearing 23. For the simpler installation of the tie rod 10, within the right foot point 6 of the first arch 5 a cylindrical recess 24 may be arranged.

If the tie rod 10 depicted in FIG. 1 and FIG. 2 is tensioned at the jacking anchorage 21, then the foot point 6 of the arch 5, which is mounted on the pillar 4, will be shifted by several millimetres towards the left, with the apex 7 of the arch 5 slightly lifting. As a consequence, the arch 5 will rise from the supporting frame. During the construction of the arch 5, the supports 12 and the road deck 3, the supporting frame will be compressed. When lifting the arch 5 by tensioning the tie rod 10, the supporting frame is relieved and deforms upwards. This elastic resilience of the supporting frame is to be taken into account when calculating the required horizontal shift of the foot point 6 of the first arch 5 above the friction bearing 23.

When relocating the intrinsic weight of the first arch 5, the supports 12 and the road deck 3 of the first structural portion, normal forces within the first arch 5 are developed. At each of the foot points 6 of the first arch 5, this normal force may be split into a vertical and a horizontal component. The vertical component for the first foot point 6 of the first arch 5, which is to the left side in FIG. 1, is taken over by the first abutment 2, and for the second foot point 6 of the first arch 5, which is to the right side in FIG. 1, it is taken over by the pillar 4. The horizontal components of the tensile forces at the first and at the second foot point 6 are equally large. By tensioning the tie rod 10, the two horizontal components are entirely taken over by the tie rod 10, causing a tensile force within the tie rod 10. The tensile force within the tie rod 10 may, for example, be slightly increased by a hydraulic press mounted at the jacking anchorage 21, which will lead to a further shift of the right foot point 6 of the arch 5, to a further lifting of the apex 7 and to a bending stress of the first arch 5 with corresponding bending moments.

Figure 3:
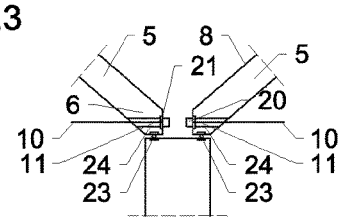
FIG. 3 shows the detail B of FIG. 5.
Figure 5:
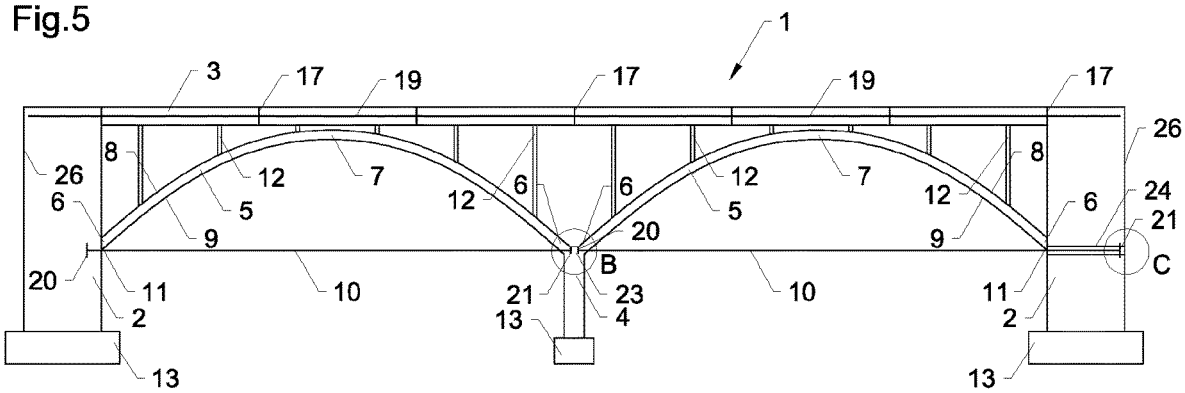
FIG. 5 shows a section through an integral bridge produced according to the method according to the first embodiment.

In a second structural portion there is produced a second arch 5, which is the last arch 5 in the present example, between the pillar 4 and a second abutment 2, which is to the right in FIG. 5. The second foot point 6 of the second arch 5, which is to the right in FIG. 5, is rigidly connected to the second abutment 2. In FIG. 3 there is depicted that the first foot point 6 of the second arch 5, which is the left one in FIG. 5, is mounted displaceably on the pillar 4 via a friction bearing 23. Subsequently, there may be produced on the top surface 8 of the second arch 5 the supports 12 and the road deck 3 having transverse joints 17.

In a next step there is installed a tie rod 10.in-between the foot points 6 of the second arch 5. Above the pillar 4, the tie rod 10 is connected using a solid anchorage 20 to the first foot point 6 of the second arch 5 in an undisplaceable, this is force-fitting, way. In order to tension the tie rod 10, there is formed preferably on the rear surface 26 of the second abutment 2 a jacking anchorage 21.

Figure 4:
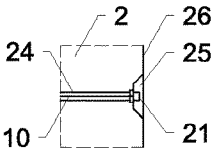
FIG. 4 shows the detail C of FIG. 5.

FIG. 4 shows a jacking anchorage 21, which is arranged in an alcove 25 on the rear surface 26 of the abutment 2. The arrangement of the jacking anchorage 21 on the rear surface 26 of the abutment 2 is advantageous, as the spanning press required for tensioning the tie rod 10, which, for example, has a length of 1.0 m, may be mounted there without any problems behind the jacking anchorage 21. When producing the abutment 2, there may be provided for this purpose a cylindrical recess 24 such that the tie rod 10 may be guided through the abutment 2 to the rear surface 26 of the abutment 2. If the tie rod 10 depicted in the FIGS. 3, 4 and 5 is tensioned at the jacking anchorage 21, the first foot point 6 of the second arch 5, which is mounted on the pillar 4, will be shifted by several millimetres towards the right, with the bottom surface 9 of the second arch 5 lifting from the formwork.

Subsequently, a reinforcement is installed in the region of the foot points 6 of the arches 5 arranged above the pillar 4, a formwork is mounted and grout is introduced. This leads to the corresponding foot points 6 of the first and the second arch 5 being interconnected in a force-fitting way and the two foot points 6 being monolithically connected to the pillar 4. The second end point 11 of the first tie rod 10 and the first end point 11 of the second tie rod 10, hence, are also interconnected in a force-fitting way. Simultaneously, the grout causes a corrosion protection for the jacking anchorage 21 and the solid anchorage 20, which are arranged above the pillar 4. The hardened grout also causes that the traffic loads are not transmitted via the friction bearings 23 but rather via the hardened grout from the foot points 6 of the arches 5 into the pillar 4.

Subsequently, the alcove 25 at the rear surface 26 of the second abutment 2 is framed and filled with grout in order to ensure the corrosion protection of the jacking anchorage 21 and of the tie rod 10. The second end point 11, in FIG. 5 the right one, of the tie rod 10 of the second, in the present example last, arch 5 is, hence, connected to the second abutment 2 in a force-fitting way.

A warming of the finished integral bridge 1 in summer leads to a lifting of the apexes 7 of the arches 5. The foot points 6 of the arches 5 and the end points 11 of the tie rods 10, which are equipped with jacking anchorages 21 and solid anchorages 20, do not change their position, as the abutments 2 may be considered as undisplaceable support structures even in the case of a temperature rise. Due to the temperature rise in the tie rods 10, the force applied to the tie rods 10 when tensioning these is being reduced. For the application of the method according to the invention it is important that the tie rods 10 will not relax in the case of a temperature rise.

In the course of planning an integral bridge 1, which is produced according to a method according to the invention, there is to be ensured that the force required for tensioning the tie rods 10 for taking up the horizontal forces from the intrinsic weight is larger than the loss of tensile force, which is possible with maximum warming of the tie rod 10. If, for example, the maximum temperature rise within the tie rod 10 is 50 degrees and the coefficient of temperature expansion of the tie rod 10 equals $10^{-5}$, the force within the tie rod 10 should lead to an expansion in the tie rod 10 of not more than 0.0005 upon tensioning. At an Young's modulus of the tie rod 10 of 200,000 N/mm$^2$, an elongation of 0.0005 corresponds to a tension of 100 N/mm$^2$. In order to provide for certain safety margins against the "relaxing" of the tie rod 10, in this example the tension in the tie rod 10 should be 150 N/mm$^2$ upon tensioning. The tension in the tie rod 10 may be set, if the horizontal force at the foot points 6 of an arch 5 is known, advantageously across the area, this is the cross-section, of the tie rod 10.

A cooling of the finished integral bridge 1 in winter will lead to a lowering of the apexes 7 of the arches 5. The foot points 6 of the arches 5 and the end points 11 of the tie rods 10 will not change their position in the case of a temperature drop. A temperature drop will lead to an increase in tension within the tie rods 10. With the values used in the above described example (Young's modulus equals 200 000 N/mm$^2$, coefficient of temperature expansion equals $10^{-5}$), a temperature drop of 50° results in an increase of tension of 100 N/mm$^2$ in the tie rods 10. If this increase of tension is multiplied with the area, this is the cross-section, of a tie rod 10, with only one tie rod 10 being arranged in each panel, this will result in an increase of the force in the tie rods 10 in the case of a temperature drop. When planning the integral bridge 1, there is to be taken into account that this force has to be taken up by the abutments 2 and has to be transmitted into the foundations 13. A possible reinforcement, which is installed in the region of the foot points 6 above the pillar 4, which is not depicted in FIG. 3 for reasons of clarity, has to be able to transmit this force from the end point 11 of the first tie rod 10 to the end point 11 of the second tie rod 10.

The abutments 2, which are, for example, connected to a dam, do not change their position in the case of a temperature rise or temperature drop. For this reason, also a road deck 3 that is arranged in-between the abutments 2 cannot change its total length in the case of a temperature difference compared to the temperature in production. In order to take up temperature deformations in the road deck 3, there may, for example, be formed transverse joints 17. In the exemplary integral bridge shown in FIG. 5 the road deck 3 has seven transverse joints 17.

In the road deck 3, rods 19, which are arranged preferably in the longitudinal direction of the integral bridge 1 and which are made from a material not at risk of corrosion, for example, made from a fibre composite material, may be embedded. These rods 19, which are preferably installed at the half height of the road deck 3, cross the transverse joints 17 at a right angle and are undisplaceably connected especially preferably to the abutments 2.

The rods 19 are optionally required in order to transmit braking forces, which are caused by vehicles or trains on the integral bridge 1, via the road deck 3 into the abutments 2 and, to a smaller extent, into the apexes 7 of the arches 5. Without the rods 19, the braking forces could be introduced via bending from the supports 12 into the arches 5. Removing braking forces via bending, however, is unfavourable as this would require the formation of large cross-sections in the supports 12 and the arches 5. The formation of large cross-sections in turn requires a high consumption of material, thus causing high costs. Removing the braking forces via tensile and compressive forces within the rods 19 is essentially less expensive than removing via bending in the supports 12 and the arches 5.

The rods 19 are preferably not connected to the road deck in the transverse joints 17. Braking forces are then only taken up by the rods 19 at the transverse joints 17. In-between the transverse joints 17, the normal forces caused by the braking forces in the rods 19 are introduced into the road deck 3 via the composite action of the rods 19.

Figure 6:
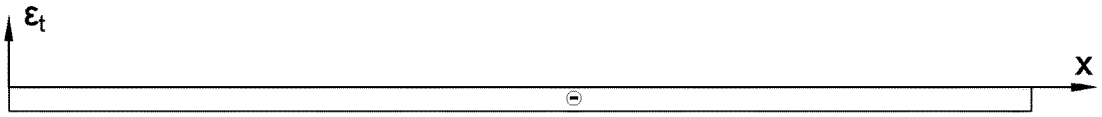
FIG. 6 shows the temperature-related distortions in a road deck of an integral bridge produced according to the method according to the first embodiment, as a consequence of a temperature drop.
Figure 7:
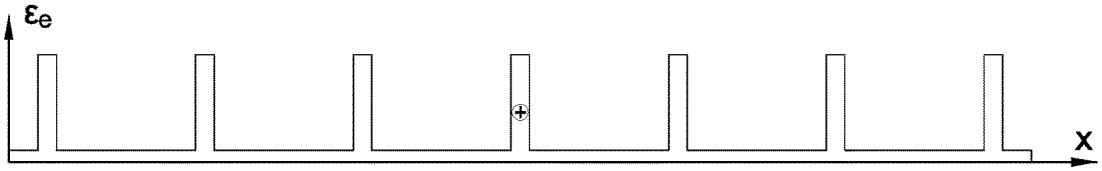
FIG. 7 shows the elastic distortions in the rods of an integral bridge produced according to the method according to the first embodiment, as a consequence of a temperature drop.
Figure 8:
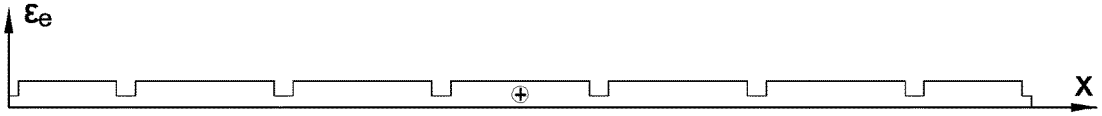
FIG. 8 shows the elastic distortions in the rods of an integral bridge produced according to the method according to a variant of the first embodiment, as a consequence of a temperature drop.

FIG. 6, FIG. 7 and FIG. 8 show a schematic illustration of the distortions in the road deck 3 or in the rods 19, respectively, in the case of a temperature drop in the integral bridge 1. The temperature-related distortions in the road deck 3 are depicted in FIG. 6. A temperature drop leads to a uniform negative distortion in the road deck 3, which equals the product of the temperature expansion coefficient of the road deck 3 and the temperature difference. The negative distortions in the road deck 3 lead to an enlargement of the width of the transverse joints 17. The original width of the transverse joints 17 is to be selected in dependency on the ambient temperature during the production of the road deck 3 such that in the case of a maximum increase of temperature in the road deck 3 the transverse joints 17 will not close completely. A closing of the transverse joints 17 would have the effect that the road deck 3 acts as a pressure member in the longitudinal direction. A further increase of the temperature upon closing of the transverse joints 17 would lead to high normal compressive forces within the road deck 3.

Assuming that the abutments 2 are undisplaceable, then these constitute, similarly to the apexes 7 of the arches 5, anchor points. The temperature-related distortions in the road deck 3 have to be compensated for by elastic distortions in the rods 19 at the transverse joints 17. FIG. 7 shows in a schematic illustration that there will occur at the transverse joints 17 larger elastic distortions than in the remaining regions of the rods 19, which form a composite with the road deck 3. The integral of the temperature-related distortions and the elastic distortions across a length X has to equal zero in-between the anchor points as well as across the entire bridge length.

A multiplication of the distortions, depicted in FIG. 7, of the rods 19 in the transverse joints with the Young's modulus and the total area of the rods 19 results in a force occurring within the rods 19 in the case of a temperature drop of the integral bridge 1. This force has to be taken up by the abutment 2 and transmitted into the foundations 13. Similar calculations are to be made for the stresses as a consequence of a temperature increase and as a consequence of the loss of material, in particular of concrete.

The tensile force arising in the rods 19 in the case of a temperature drop may be reduced if the composite action between the rods 19 and the road deck 3 is partially neutralized. This may, for example, be achieved by guiding plastic tubes over the rods in certain regions before the introduction of the concrete for the production of the road deck 3. FIG. 8 shows a depiction of the elastic distortions in the rods 19 along the integral bridge 1, which corresponds to FIG. 7, for an alternative embodiment, wherein the composite action between the rods 19 and the road deck 3 is neutralized in large regions. The rods 19 in this alternative embodiment are only in direct contact with the concrete at the two abutments 2 and at six points of the road deck 3, which are situated in the centre between two transverse joints 17. In all remaining regions, the connection is interrupted, for example, by the guiding of plastic tubes onto the rods 19 before the introduction of the concrete for the production of the road deck 3. Due to this alternative embodiment there is achieved that the tensile forces in the rods 19, in the case of a temperature drop, are essentially reduced, as may be seen when comparing FIG. 7 and FIG. 8.

If the width of the transverse joints 17 is selected large enough such that in the case of a temperature rise there will be no direct contact between the parts of the road deck 3 separated by a transverse joint 17, the increase of the elastic distortions in the rods 19 will be favourably affected by the neutralization of the connection between the rods 19 and the road deck 3, similarly to the case of a temperature drop.

Traffic loads acting on the integral bridge 1 in a panel will be taken up in an integral bridge 1 produced according to the method according to the invention advantageously by forces in the tie rods 10 and only to a smaller extent by bending moments in the pillars 4. Stress by traffic onto the right panel, this is the second arch 5, of the bridge illustrated in FIG. 5 is transmitted by the supports 12 from the road deck 3 into the second arch 5. In the second arch 5 there are developed predominantly compressive forces. At the foot point 6 the vertical components of the compressive forces are transmitted into the pillar 4 and into the abutment 2. The horizontal components of the compressive forces generate an increase of the tensile force within the tie rod 10 of the right panel and a reduction of the tensile force within the tie rod 10 of the left panel that is not stressed. The bending stress of the pillar 4 is small.

The production of an exemplary integral bridge 1, preferably made from concrete having a reinforcement made from fibre composite material, according to a second embodiment of the method according to the invention is shown in the FIG. 9 to FIG. 14.

Figure 9:
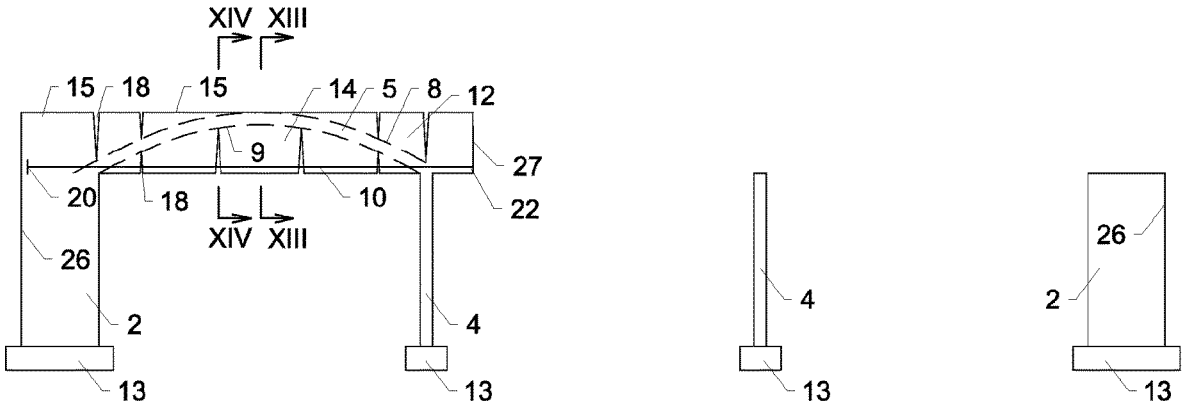
FIG. 9 shows a section through an integral bridge during a first structural portion of a method according to the invention according to a second embodiment.

FIG. 9 shows the abutments 2 and the pillar 4 that are produced in advance as well as the production of the first structural portion of the integral bridge 1. The arch 5, the supports 12 and the road deck 3 are simultaneously produced in a construction part 14 having a plane top surface 15 and a plane bottom surface 16 on a formwork and a supporting frame, which is not depicted in FIG. 9 for reasons of clarity. The arch 5 is an integral part of the construction part 14 and is formed by slits 18 inserted into the construction part, wherein the dimensions of the arch 5 are a result of the depth of the slits 18 in the construction part.

The slits 18 may be realised by formwork elements or by lost inserts made from a soft material, such as, e.g., extruded polystyrene, in the production of the construction part 14. In the first arch 5, which is depicted using dashed lines in FIG. 9, there are arranged four slits 18, which extend from the bottom surface 16 of the construction part 14 to the bottom surface 9 of the arch 5. Four further slits 18, which extend from the top surface 15 of the construction part 14 to the top surface 8 of the arch 5, are arranged in the first arch 5.

The first structural portion does not end above the pillar 4 but rather in the first panel at a coupling joint 27. This has the advantage that the coupling joint 27 is not arranged above the highly statically stressed location above the pillar 4.

Figure 13:
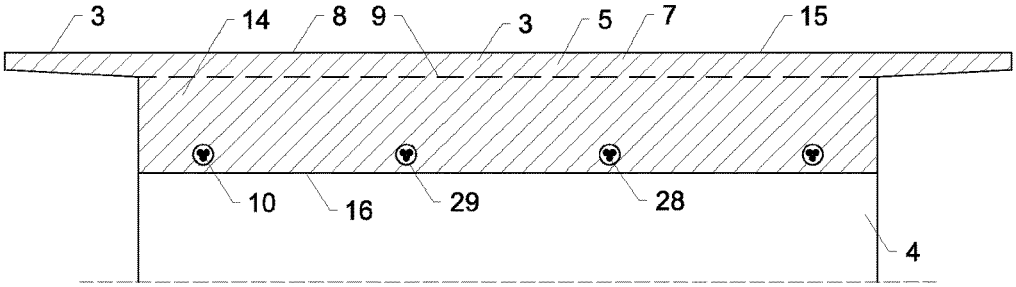
FIG. 13 shows a section along the line XIII-XIII of FIG. 9.

The section depicted in FIG. 13 shows that the road deck 3, which is monolithically connected to the construction part 14 and forms an integral part of the construction part 14, has lateral projections. The width of the construction part 14 corresponds to the width of the pillar 4. The bottom surface 9 of the arch 5 is in FIG. 13 depicted by a horizontal dashed line. Only the cross-section area of the arch 5 and the tie rods 10 are statically effective for removing the loads from the intrinsic weight and the traffic in the cross-section shown in FIG. 13. The material arranged underneath the bottom surface 9 of the arch 5, in particular concrete, does not contribute to the removal of loads. A production of the construction part 14 having a planar bottom surface 16, however, may also have advantages in the construction. Furthermore, the material arranged underneath the bottom surface 9 of the arch 5, in particular concrete, will protect the tie rods 10 against environmental effects and vandalism.

Figure 14:
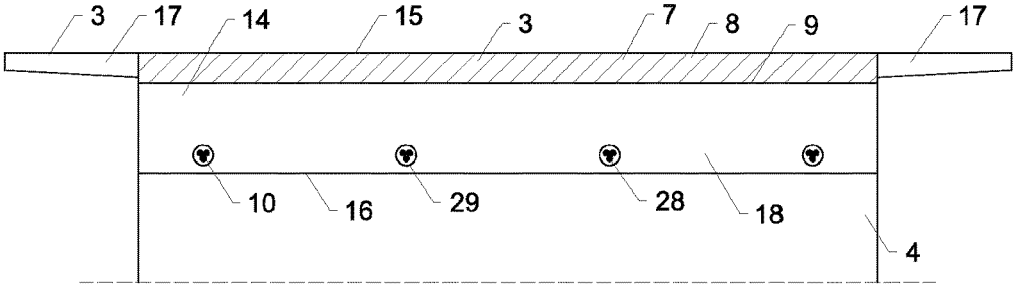
FIG. 14 shows a section along the line XIV-XIV of FIG. 9.

The section shown in FIG. 14 extends through a slit 18 extending from the bottom surface 16 of the construction part 14 to the bottom surface 9 of the arch 5. In this section there are preferably arranged transverse joints 17 in the projecting regions of the road deck 3 in order to enable the longitudinal expansion, free of constraint forces, of the projecting parts of the road deck 3 in the case of a temperature drop or in the case of a rise in temperature. The longitudinal reinforcement of the road deck 3 in the present example is not passed through the slits 18 and the transverse joints 17. Due to the reinforcement, there will not be introduced any normal forces as a consequence of a temperature rise or temperature drop in the integral bridge 1 into the abutments 2.

The tie rods 10 are in this example made from tendons with subsequent connection. The span wire strands are arranged in sheathings 29, for example, made from polyethylene, which are in a connection with the concrete of the construction part 14. The FIGS. 13 and 14 show that in the construction part 14 there are installed four tie rods 10 extending in the longitudinal direction of the integral bridge 1. A reinforcement made from fibre composite material, which is preferably to be applied, is not depicted in the cross-sectional views shown in the FIGS. 13 and 14 for reasons of clarity. The use of a reinforcement made from fibre composite material is advantageous, as such a reinforcement is not at a risk of corrosion.

FIG. 9 shows that the tie rods 10 may be installed at the rear surface 26 of the abutments 2 using a solid anchorage 20. At the coupling joint 27, the tie rods 10 may each have a coupling 22. The couplings 22 enable the tensioning of the tie rods 10 in the first structural portion, acting as solid anchorages 20 for the tie rods 10 of the second structural portion.

Before the supporting frame is lowered, the tie rods 10 of the first structural portion are tensioned to 75% of the force according to plan. Subsequently, the supporting frame is lowered. Lowering the supporting frame causes the activation of the supporting effect of the arch 5-tie rod 10, and it is associated with an increase of the force within the tie rods 10 to the force according to plan and a slight deformation of the pillar 4 to the right. Subsequently, the pillar 4, for example using the hydraulic pressings mounted at the couplings 22, is returned to the vertical position. Subsequently, the sheathings 29 of the tie rods 10 may be filled with cement mortar in order to produce the connection between the span wire strands 28 and the construction part 14. After hardening the compressed mortar, the tie rods 10 are undisplaceably connected above the pillar 4 to the construction part 14 and via a connecting reinforcement also to the pillar 4. In order to activate the supporting effect of the arch 5-tie rod 10 in the case of a panel-wise traffic load, the static connection of the tie rods 10 to the construction part 14 via the hardened filling mortar will be sufficient.

Figure 10:
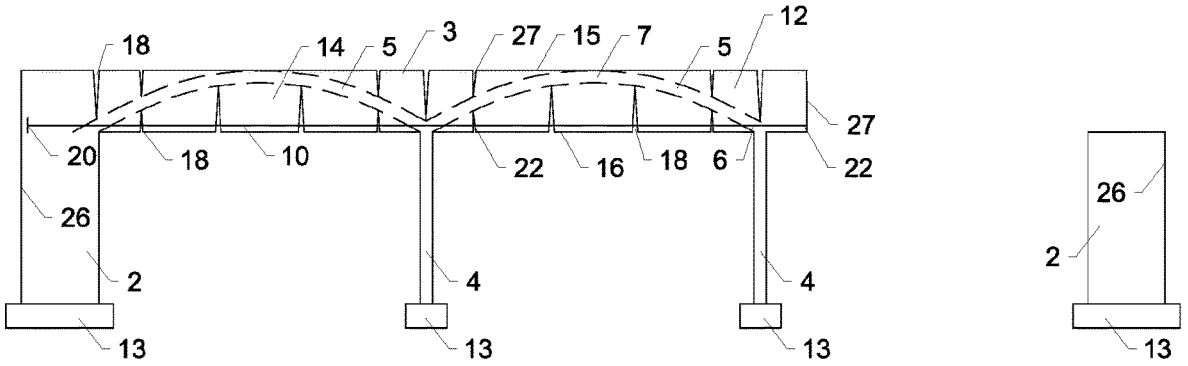
FIG. 10 shows a section through an integral bridge during a second structural portion of a method according to the invention according to a second embodiment.

The production of a second structural portion is depicted in FIG. 10. The second structural portion extends from the first coupling joint 27 to a second coupling joint 27. The formwork for the construction part 14 is produced on a supporting frame. Subsequently, the reinforcement made from fibre composite material is installed, with the tie rods 10 being produced. The tie rods 10 are anchored to the couplings 22 of the first coupling joint 27 and equipped with couplings 22 at the second coupling joint 27. Slits 18 and transverse joints are produced. Subsequently, concrete is being introduced. After hardening of the concrete of the second structural portion, the tie rods 10 are tensioned, and the further working steps are performed such as in the first structural portion.

Figure 11:
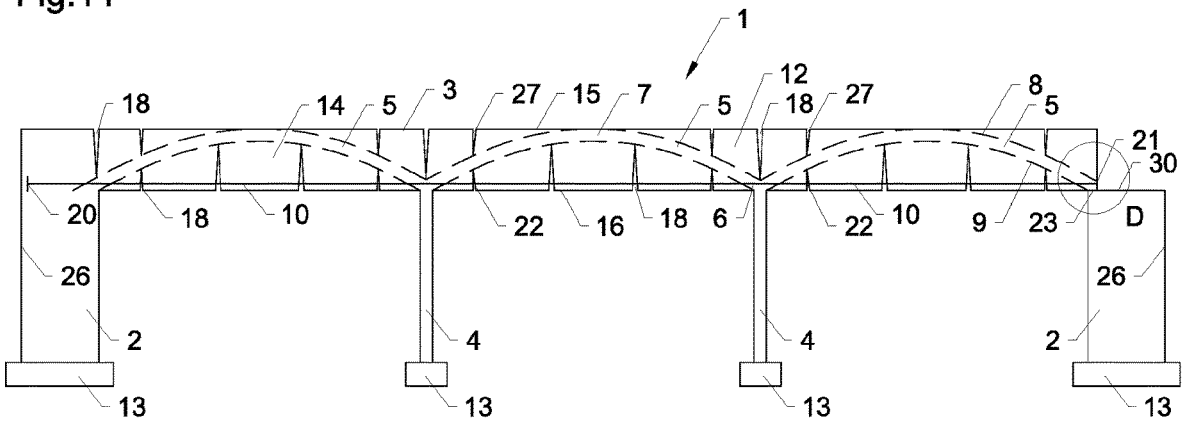
FIG. 11 shows a section through an integral bridge during a third structural portion of a method according to the invention according to a second embodiment.

The production of a third structural portion is depicted in FIG. 11. The tie rods 10 of the third structural potion are attached at the first, in FIG. 11 left, end point 11 of the third structural portion to the couplings 22 of the second coupling joint 27 and equipped at the second, in FIG. 11 right, end point 11 with a jacking anchorage 21.

Figure 12:
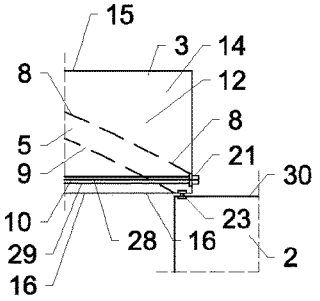
FIG. 12 shows the detail D of FIG. 11.

FIG. 12 shows that there is to be installed a friction bearing 23 at the second, in the FIG. 11 right, foot point 6 of the third arch 5 in order to ensure that when the supporting frame is lowered the horizontal force arising at the second foot point 6 of the third arch 5 is transmitted into the tie rods 10 and not into the undisplaceable abutment 2. In the abutment 2 there is produced a horizontal construction joint 30 preferably at the height of the friction bearing in order to enable a possible application of the hydraulic presses at the jacking anchorages 21. In the next working step, the third structural portion is casted. Subsequently, one has to wait until the concrete of the third structural portion has the required rigidity for lowering the supporting frame. After lowering the support frame and after tensioning the tie rods 10, the upper portion of the abutment 2 is preferably reinforced and casted.

A back-anchoring of the second foot point 6 of the third arch 5 using connecting reinforcement into the abutment 2 is to be performed in order to ensure that tensile forces resulting from a temperature drop may be transmitted from the tie rods 10 into the right abutment 2. The friction bearing 23 underneath the second foot point 6 of the third arch 5 becomes functionally ineffective upon completion of the abutment 2, as it is surrounded by concrete.

Figure 15:
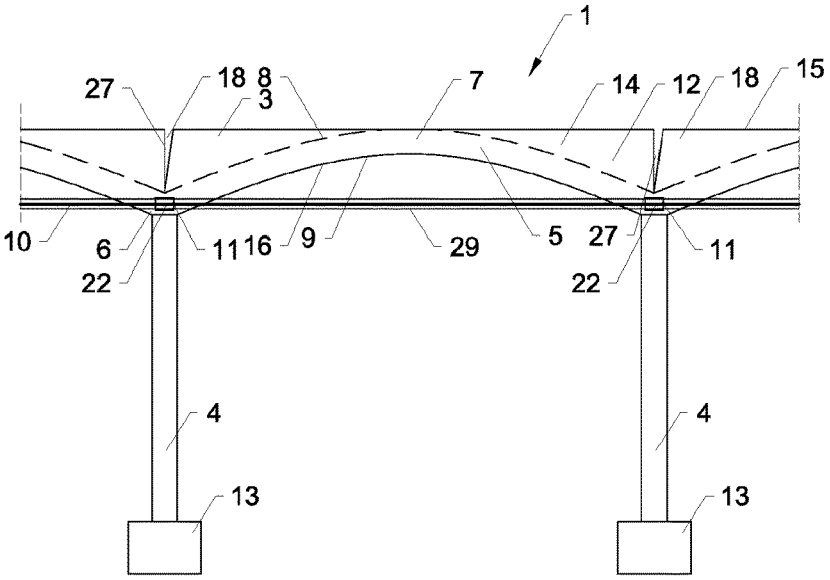
FIG. 15 shows a section through an integral bridge according to the invention according to a third embodiment.

The production of an exemplary integral bridge 1 using the method according to the invention according a third embodiment is depicted in FIG. 15. FIG. 15 shows a cut-out of a multi-panel integral bridge 1, which is produced in structural portions of respectively one panel. Coupling joints 27, into which the couplings 22 may be installed, are arranged above the pillars 4. In the coupling joints 27 there are produced slits 18.

A construction part 14 has in each panel a planar top surface 15. The curved bottom surface 16 of the construction part 14 is identical to the bottom surface 9 of an arch 5. The production of the curved bottom surface 16 of the construction part is cumbersome, as there has to be produced a curved formwork. The increased efforts, however, provide for the production of an integral bridge 1 having reduced material consumption.

In this embodiment variant the tie rods 10 are arranged partly outside of the construction part 14. The tie rods 10 may be produced as externals tendons having mono-strands in a sheathing 29, preferably made from plastic material. A final filling of the sheathings 29 with cement mortar is not necessary as the connection of the end points 11 of the tie rods 10 with the foot points 6 of the arches 5 is produced by the casted couplings 22.

Figure 16:
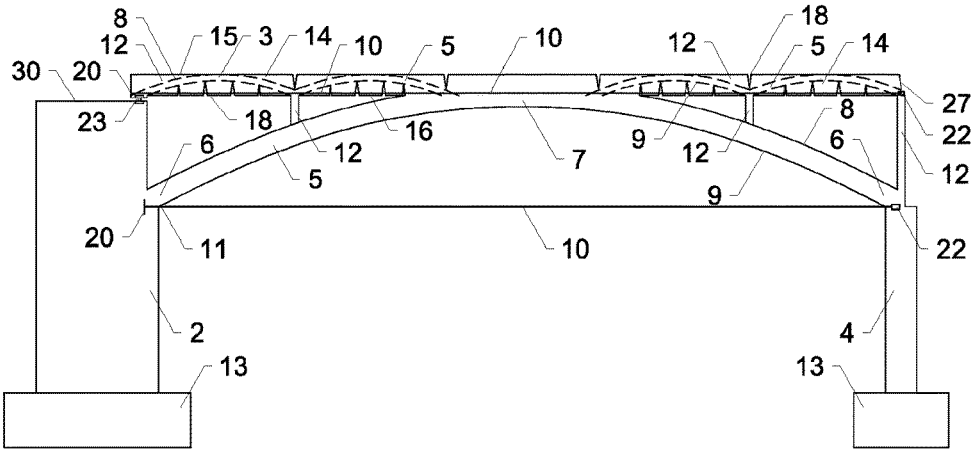
FIG. 16 shows a section through an integral bridge during a first structural portion of a method according to the invention according to a fourth embodiment.
Figure 17:
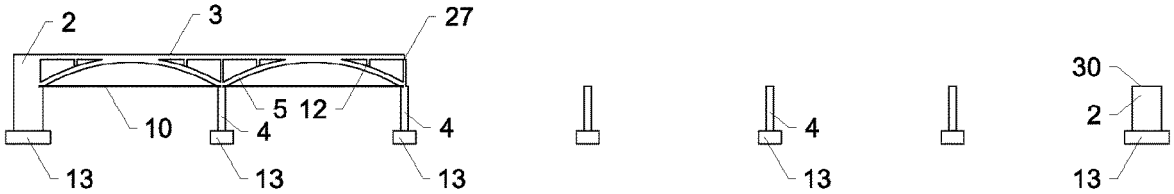
FIG. 17 shows a section through an integral bridge during a second structural portion of a method according to the invention according to a fourth embodiment.
Figure 18:
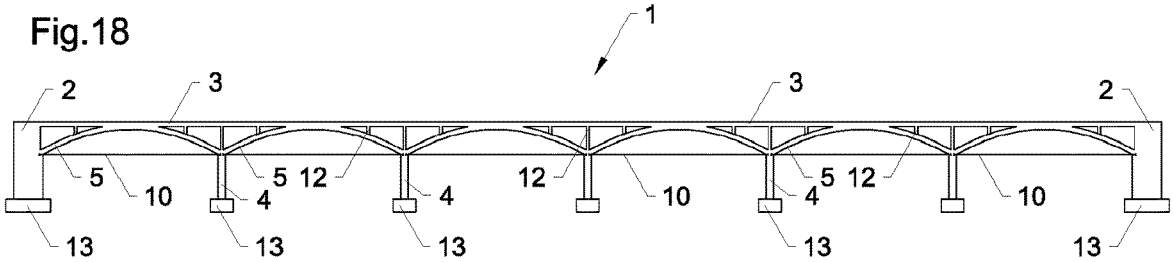
FIG. 18 shows a section through an integral bridge produced according to the method according the fourth embodiment.

The production of an exemplary integral bridge 1 using a method according to the invention according to a fourth embodiment is depicted in the FIG. 16 to FIG. 18.

FIG. 16 shows a preliminarily produced abutment 2, a pillar 4 and the production of the first structural portion of the integral bridge 1.

On a formwork and on a supporting frame, there is produced an arch 5 spanning the first panel from the abutment 2 to the first pillar 4. In the region of the apex 7 of the arch 5, the road deck 3 and the arch 5 penetrate each other. It is advantageous to produce this segment of the road deck 3 simultaneously with the arch 5. In-between the foot points 6 of the arches 5 there are installed the tie rods 10, which are formed as external tendons. The tie rods 10 have a solid anchorage 20 in the abutment as well as a coupling 22 above the pillar 4.

On the arch 5, there are subsequently produced vertical supports 12. Due to the supports 12, the road deck 3 is in this panel divided into four sections.

In the next step, there are produced in these four sections on a formwork and on a supporting frame construction parts 14 having a planar top surface 15 and a planar bottom surface 16. By the slits 18 extending from the top surface 15 of the construction parts 14 to the top surface 8 of the arches 5 and from the bottom surface 16 of the construction parts 14 to the bottom surface 9 of the arches 5 there are formed in the constructions parts 14 further arches 5 having a smaller arch span width. Consequently, in this fourth embodiment there are produced in one structural portion respectively five arches 5. The first arch 5 is hereby the same as in the preceding examples, in FIG. 16 the arch 5 having the largest arch span width. The supporting effect in these construction parts 14 is the same as in the embodiment example depicted in FIG. 9. It is advantageous to equip the four aches 5 in the road deck 3 with tie rods 10, which have a solid anchorage 20 above the abutment 2 and a coupling 22 at the coupling joint 27 above the pillar 4 between the first and the second structural portion. Underneath the solid anchorages 20, it is advantageous to arrange a friction bearing 23 between the construction part 14 and the abutment 2 in order to ensure the deformation capacity of the two first, in FIG. 16 left, construction parts 14 when lowering the supporting frame and when tensioning the tie rods 10. The deformation capacity at the second, in FIG. 16 right, end of the first structural portion is ensured by the resilience of the supports 12 and of the pillar 4.

Tensioning the tie rods 10 of the arch 5, which extends from the abutment 2 to the first pillar 4, and the tie rods 10 in the construction parts 14 is realized advantageously in steps simultaneously with the lowering of the supporting frame. After lowering the supporting frame and tensioning the tie rods 10, the pillar 4 and the supports 12 arranged underneath the coupling joint 27 are again in the perpendicular position according to plan. During the lowering of the supporting frame and the tensioning of the tie rods 10 there may occur slight horizontal shifts of the pillar 4 and of the supports 12 underneath the coupling joint 27, which, however, may be taken up without any problems by the flexible supporting elements.

FIG. 17 shows the production of a second structural portion, which is realized similarly to the production of the first structural portion. The only difference is that the tie rods 10 are anchored at the couplings 22 of the first structural portion rather than at the solid anchorages 20.

The finished integral bridge 1 having six panels or structural portions, respectively, is depicted in FIG. 18. The last arch 5 is hereby the same as in the preceding examples, in FIG. 18 the arch 5 having the larger arch span width, which is depicted in FIG. 18 farthest to the right.

Figure 19:
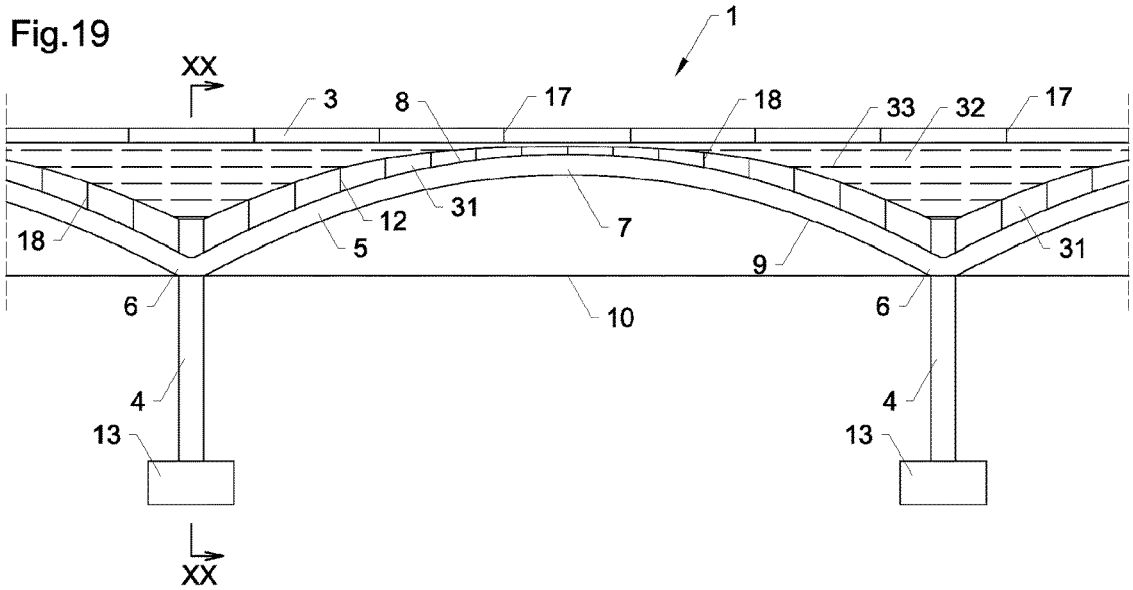
FIG. 19 shows a view of an integral bridge according to the invention according to a fifth embodiment.
Figure 20:
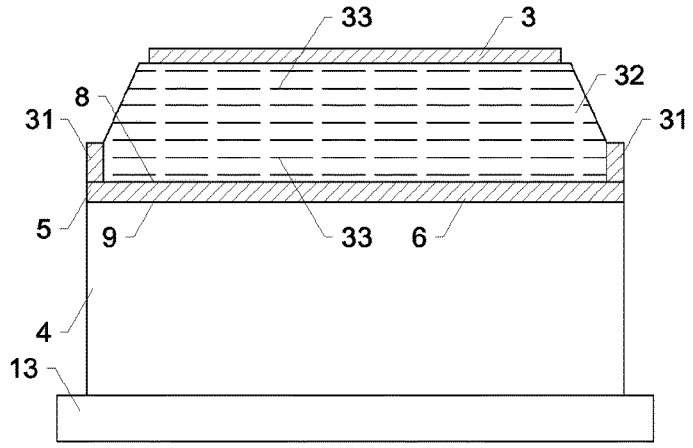
FIG. 20 shows a section along the line XX-XX of FIG. 19.

The production of an exemplary integral bridge 1 using the method according to the invention according to a fifth embodiment is depicted in the FIG. 19 and FIG. 20.

FIG. 19 shows a cut-out of a multi-panel integral bridge 1 in a view. On the arches 5, there are attached supporting elements 31. The supporting elements 31 are separated from one another by slits 18, such that the supporting effect of the arches 5 will not be influenced by the supporting elements 31. FIG. 20 shows that the supporting elements 31 are merely attached laterally on the arches 5. In-between the supporting elements 31 there is applied a filling 32 onto the top surface 8 of the arches 5. The filling 32 may, for example, be composed of gravel grains or of the material of the building site removed for the production of the foundations 13. Geogrids 33 may be arranged within the filling 32 in order to enable the provision of a steeper angle of slope. The road deck 3 is produced on the filling 32. Within the road deck 3 there are produced transverse joints 17, such that no forces in the longitudinal direction of the integral bridge 1 will arise in the case of temperature variations.

Figure 21:
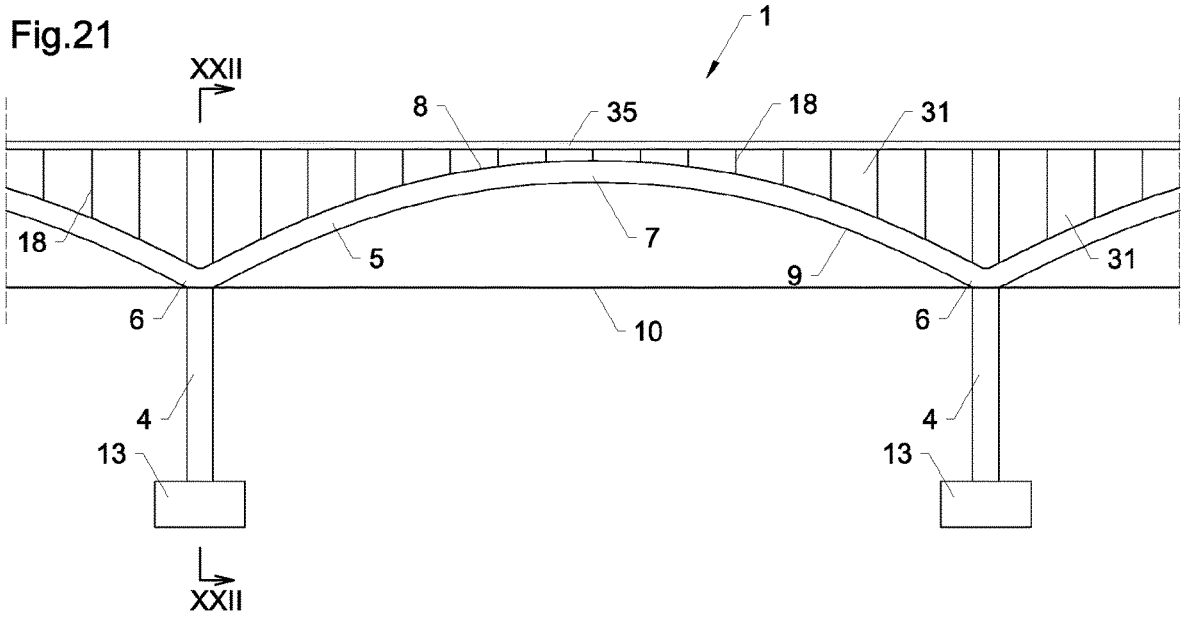
FIG. 21 shows a view of an integral bridge according to the invention according a sixth embodiment and FIG. 22 shows a section along the line of XXII-XXII of FIG. 21.
Figure 22:
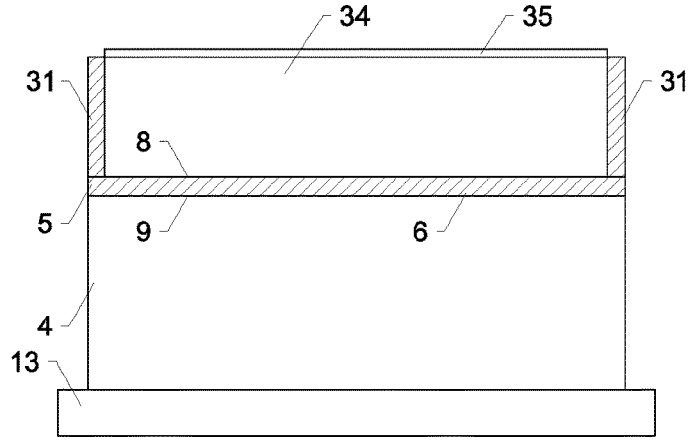

The production of an exemplary integral bridge 1 using the method according to the invention according to a sixth embodiment is depicted in FIG. 21 and FIG. 22.

FIG. 21 shows a cut-out of a multi-panel integral bridge 1 in a view. On the arches 5, there are attached supporting elements 31. The supporting elements 31 are separated from one another by slits 18, such that the supporting effect of the arches 5 will not be influenced by the supporting elements 31. FIG. 22 shows that the supporting elements 31 are attached laterally on the arches 5. In-between the supporting elements 31 there are produced blocks 34 on the top surface 8 of the arches 5. The blocks 34 may, for example, be made from lightweight concrete, gas concrete or foamed concrete. At the locations, where the slits 18 are provided between the supporting elements 31, also the blocks 34 are separated from one another by way of slits 18. The production of a slit 18 in-between two blocks 34 may, for example, by realized by inserting a soft inlay of extruded polystyrene. The road deck surface 35 is applied onto the blocks 34. The road deck surface 35 is composed of an asphalt mixture, which is able to take up the joint openings, which occur at the slits 18 as a consequence of a temperature drop, without the formation of cracks.

In an alternative embodiment the formation of the supporting elements 31 that are arranged laterally on the arches 5 may be omitted. In this case, the lateral surfaces of the blocks 34 are supported during production by formwork elements.

In a further alternative embodiment, the formation of the slits 18 between the blocks 34 may be omitted. This alternative embodiment is made possible if the blocks 34 are composed of a material having a very low tensile strength, for example of 0.5 $N/mm^2$, and a low Young's modulus, for example, of 3000 $N/mm^2$. The low tensile strength would lead to the occurrence of cracks within the blocks 34 in the case of a temperature drop. The low Young's modulus would lead to the occurrence of only low compressive forces in the longitudinal direction of the integral bridge 1, which have to be taken up by the abutments 2, in the case of an increase of temperature.

In the examples, the production of integral bridges 1 in an in-situ-concrete method having a formwork that is supported by a supporting frame was described.

Analogously, the method according to the invention may also be used for the production of integral bridges 1 using prefabricated elements. Alternatively, also any other pourable material, which fulfils the requirements in regard to statics and strength, may be used, for example, "green concrete", to which additives of lime scale or dolomite brick grains have been added.

REFERENCE LIST

1 integral bridge
2 abutment
3 road deck
4 pillar
5 arch
6 foot point of an arch
7 apex of an arch
8 top surface of an arch
9 bottom surface of an arch
10 tie rod
11 end point of a tie rod
12 support
13 foundation
14 construction part

15 top surface of a construction part
16 bottom surface of a construction part
17 transverse joint
18 slit
19 rod
20 solid anchorage
21 jacking anchorage
22 coupling
23 friction bearing
24 recess
25 alcove
26 rear surface of the abutment
27 coupling joint
28 span wire strand
29 sheathing
30 construction joint
31 support element
32 filling
33 geogrid
34 block
35 road deck surface

The invention claimed is:

1. A method for producing an integral bridge made from reinforced concrete and having a road deck, wherein the integral bridge is produced in sections, and wherein there are preliminarily erected a first abutment, and at least one pillar, and the method comprising:

producing, in a first structural portion, a first arch with a first tie rod, which interconnects foot points of the first arch, wherein one of the foots point of the first arch is displaceably mounted, and wherein the first tie rod is tensioned such that horizontal forces, which are caused by an intrinsic weight of the first arch at the foot points of the first arch, are taken up by the first tie rod;

producing, in a second structural portion, a second arch with a second tie rod, which interconnects the foot points of the second arch, wherein one of the foot points of the second arch is displaceably mounted, and wherein the second tie rod is tensioned such that horizontal forces, which are caused by the intrinsic weight of the second arch at the foot points of the second arch, are taken up by the second tie rod;

producing, before or during production of the second structural portion, a second abutment, connecting a first end point of the first tie rod in a force-fitting manner to the first abutment, and connecting a second end point of the second tie rod of the second arch in a force-fitting manner to the second abutment;

connecting the second end point of the first tie rode to the first end point of th second tie rod in a force-fitting manner; and connecting the respective foot points of the first arch and the second arch in a force-fitting manner to the abutments and to the pillar.

2. A method according to claim 1, wherein connection of one of the foot points to the pillar is performed during production of one of the structural portions of the integral bridge.

3. A method according to claim 1, wherein one force-fitting connection of one of the end points is performed during a section-wise production of the integral bridge.

4. A method according to claim 1, wherein one of the tie rods is tensioned to a tensile stress of 80 $N/mm^2$ to 500 $N/mm^2$.

5. A method according to claim 1, wherein an end point of one of the tie rods is formed as one of a solid anchorage, a jacking anchorage, or a coupling.

6. A method according to claim 1, wherein one of the tie rods is formed as a tendon, and the method further comprises:

connecting the tendon with a sheathing; and grouting the tendon with cement mortar after tensioning of the tie rod.

7. A method according to claim 1, wherein one of the tie rods is formed as an external tendon during the section-wise production of the integral bridge, and wherein that tie rod is equipped with a permanent corrosion protection, or is produced from a material not at risk of corrosion.

8. A method according to claim 1, further comprising producing supports on at least one arch and that wherein the road deck is produccd resides on the supports.

9. A method according to claim 8, wherein one of the tie rods is tensioned such that the horizontal forces, which are caused by the intrinsic weight of either the first arch or the second arch, the supports and the road deck at the foot points of the arch, are taken up by that tie rod.

10. A method according to claim 1, further comprising producing transverse joints, in lateral projections of the road deck, in an interval of 1 m to 10 m.

11. A method according to claim 10, wherein rods made from fibre composite material and/or from stainless steel are arranged within the road deck, and wherein the rods cross the transverse joints at a right angle.

12. A method according to claim 2, wherein the constructional part comprises a reinforcement made from fibre composite material and/or from stainless steel.

13. A method according to claim 1, further comprising producing two or more additional arches having a common additional tie rod, wherein the additional tie rod is rigidly connected at a first end point thereof to a foot point of a first arch of the additional arches and is displaceably connected to the remaining foot points of the two or more additional arches upon tensioning of the additional tie rod.

14. A method according to claim 1, wherein in at least one of the structural portions comprises at least two arches.

15. A method according to claim 14, further comprising producing, on the supports of an arch, one or more arches having a smaller arch span width than an arch span width of the arch.

16. A method according to claim 1, wherein in regions adjoining the transverse joints, a composite action between the first and second tie rods and the road deck is omitted.

17. An integral bridge made from reinforced concrete and having at least two arches and at least one pillar, wherein the bridge has been produced using the method according to claim 1, wherein one of the arches has a ratio of clear arch span width to clear rise of that arch, greater than 2.

18. An integral bridge according to claim 17, wherein a ratio of clear arch span width to a width of the pillar in a longitudinal direction of the bridge, has a value greater than 5.

19. A method, for producing an integral bridge made from reinforced concrete and having a road deck, wherein the integral bridge is produced in sections, and wherein there are preliminarily erected a first abutment, and at least one pillar, and the method comprising:

producing, in a first structural portion, a first arch with a first tie rod, which interconnects foot points of the first arch, wherein one of the foots point of the first arch is displaceably mounted, and wherein the first tie rod is tensioned such that horizontal forces, which are caused by an intrinsic weight of the first arch at the foot points of the first arch, are taken up by the first tie rod;

producing, in a second structural portion, a second arch with a second tie rod, which interconnects the foot points of the second arch, wherein one of the foot points of the second arch is displaceably mounted, and wherein the second tie rod is tensioned such that horizontal forces, which are caused by the intrinsic weight of the second arch at the foot points of the second arch, are taken up by the second tie rod;

producing, before or during production of the second structural portion, a second abutment, connecting a first end point of the first tie rod in a force-fitting manner to the first abutment, and connecting a second end point of the second tie rod of the second arch in a force-fitting manner to the second abutment;

connecting the second end point of the first tie rode to the first end point of the second tie rod in a force-fitting manner;

connecting the respective foot points of the first arch and the second arch in a force-fitting manner to the abutments and to the pillar; and producing supports on at least one arch, and wherein the road deck resides on the supports, wherein in one of the first arch or the second arch, the supports and the part of the road deck that is arranged above the first arch or second arch are produced simultaneously in a constructional part, and in the constructional part there are produced slits having an essentially plane top surface, which are situated in planes that are arranged perpendicularly to an axis of one of the first tie rod or the second tie rod, and the slits have a depth which extends from a top surface of the constructional part to a top surface of the first arch or the second arch.

20. A method for producing an integral bridge made from reinforced concrete and having a road deck, wherein the integral bridge is produced in sections, and wherein there are preliminarily erected a first abutment, and at least one pillar, and the method comprising:

producing, in a first structural portion, a first arch with a first tie rod, which interconnects foot points of the first arch, wherein one of the foots point of the first arch is displaceably mounted, and wherein the first tie rod is tensioned such that horizontal forces, which are caused by an intrinsic weight of the first arch at the foot points of the first arch, are taken up by the first tie rod;

producing, in a second structural portion, a second arch with a second tie rod, which interconnects the foot points of the second arch, wherein one of the foot points of the second arch is displaceably mounted, and wherein the second tie rod is tensioned such that horizontal forces, which are caused by the intrinsic weight of the second arch at the foot points of the second arch, are taken up by the second tie rod;

producing, before or during production of the second structural portion, a second abutment, connecting a first end point of the first tie rod in a force-fitting manner to the first abutment, and connecting a second end point of the second tie rod of the second arch in a force-fitting manner to the second abutment;

connecting the second end point of the first tie rode to the first end point of the second tie rod in a force-fitting manner;

connecting the respective foot points of the first arch and the second arch in a force- fitting manner to the abutments and to the pillar; and producing supports on at least one arch, and wherein the road deck resides on the supports, wherein in one of the first arch and the second arch, the supports and a part of the road deck that is arranged above the first arch or the second arch are produced simultaneously in a constructional part, and in the constructional part there are produced slits having an essentially plane top surface and an essentially plane bottom surface and the top surface and bottom surface of each slit are situated in respective planes that are arranged perpendicularly to an axis of one of the first tie rod or the second tie rod, and the slits have a depth which extends either from a bottom surface of the constructional part to a bottom surface of one of the first arch or the second arch or from a top surface of the constructional part to a top surface of one of the first arch or the second arch.

* * * * *